United States Patent [19]

Lasher

[11] 4,167,903

[45] Sep. 18, 1979

[54] NEWSPAPER BALING DEVICE

[76] Inventor: George D. Lasher, 4272 N. Hughes, Apt. 108, Fresno, Calif. 93705

[21] Appl. No.: 889,279

[22] Filed: Mar. 23, 1978

[51] Int. Cl.[2] ..... B65B 13/18

[52] U.S. Cl. ..... 100/34; 206/577; 211/50

[58] Field of Search ..... 100/1, 3, 24, 34; 211/50; D9/259; 206/223, 577, 586

[56] References Cited

U.S. PATENT DOCUMENTS

| | | | |
|---|---|---|---|
| 2,418,550 | 4/1947 | Edwards | 100/34 X |
| 2,575,048 | 11/1951 | Dankert | 100/34 X |
| 3,145,646 | 8/1964 | Levy | 100/34 |
| 3,782,619 | 1/1974 | Dittbenner | 206/577 |
| 3,897,724 | 8/1975 | McDonald | 100/34 |

FOREIGN PATENT DOCUMENTS

| | | | |
|---|---|---|---|
| 570299 | 12/1975 | Switzerland | 100/34 |

*Primary Examiner*—Billy J. Wilhite
*Attorney, Agent, or Firm*—Huebner & Worrel

[57] ABSTRACT

A baling device for use in baling layered material such as folded newspapers and the like, characterized by a planar base having defined therein an upwardly opening cruciform slot for accommodating the passage of a twine-bearing needle beneath a stack of materials supported thereby; angularly configured support members removably disposed at each of the four corners of the base for laterally supporting each of the vertical sides of the stack; and a housing telescopically received by the supports including a hinge cover for accommodating access to the interior of the device.

4 Claims, 3 Drawing Figures

NEWSPAPER BALING DEVICE

BACKGROUND OF THE INVENTION

1. Field of the Invention

The invention relates to newspaper storage and baling devices and more particularly to a newspaper baling device adapted to receive folded newspapers to form stacks and subsequently accommodate a baling of the stacks of newspaper.

2. Description of the Prior Art

The prior art is, of course, replete with storage devices for folded material such as newspapers and the like. Frequently, such storage devices conform generally to a box having vertical sides wherein newspapers are stored to form stacks and thereafter removed to receive a circumscribing length of baling twine.

As can be appreciated by those familiar with the baling of newspapers and the like, stacks of substantial sizes are relatively heavy and generally difficult to handle, particularly during the initial stages of binding the stacks with binder twine. Moreover, where newspapers and the like are gathered through so-called drives, sponsored by civic organizations, it is desirable that those potentially involved in the effort be provided "kits" which can readily be assembled into receiver bins for use in the home and the like. Of course, such kits must be economic to purchase, easy to handle and assemble and generally be of a pleasing appearance in order to enhance their usage.

It is, therefore, the general purpose of the instant invention to provide a simple and economic baling device characterized by an appearance which enhances use as a collection receptacle for newspapers in homes, offices and the like, while being particularly useful as a baling device for use in the formation of bales of collected newspapers.

OBJECT AND SUMMARY OF THE INVENTION

It is an object of the instant invention to provide a baling device particularly suited for use as both a collection receptacle and as a device for use in the baling of collected newspapers in homes, offices and the like.

DESCRIPTION OF THE PREFERRED EMBODIMENT

Figure 1:
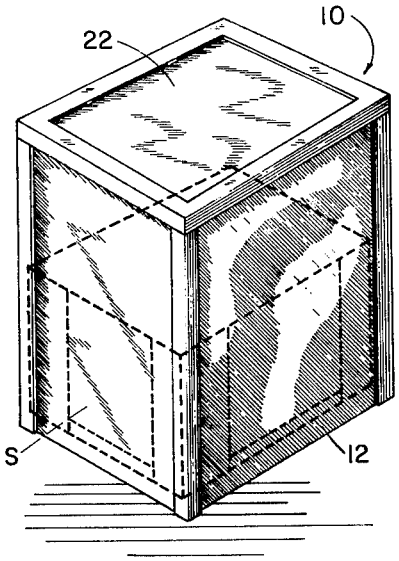
FIG. 1 is a perspective view of a baling device which embodies the principles of the instant invention.

Referring now to the drawings wherein like reference characters designate like or corresponding parts throughout the several views, there is shown in FIG. 1 a baling device, generally designated 10, which embodies the principles of the instant invention.

The baling device 10, as shown in FIG. 1, includes a housing 12 of a generally rectangular, tube-shaped configuration. As a practical matter, the housing 12 serves as a cover for a stack of collected newspapers, designated S, and is formed of any suitable material which tends to impart thereto a pleasing appearance. A pleasing appearance for the device 10 tends to ensure its utility in homes, offices and the like, as a means through collection and storage of newspapers.

Figure 2:
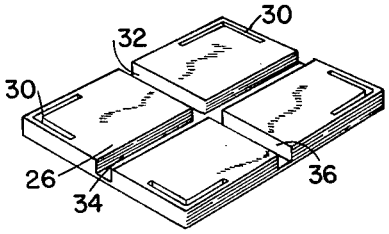
FIG. 2 is a perspective exploded view of the device.
Figure 2:
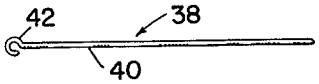

The housing 12, as shown, includes vertical side panels 14, 16, 18 and 20, arranged to form an open-end tubular body, as well as a hinged cover 22 for one end thereof. The particular manner in which the hinged cover 22 is connected to the housing 12 is varied as desired. However, as shown in FIG. 2, the cover is connected through a piano hinge 24 of conventional construction. In any event, it is to be understood that the cover 22 typically is supported to be displaced for affording access to the interior of the housing.

Figure 3:
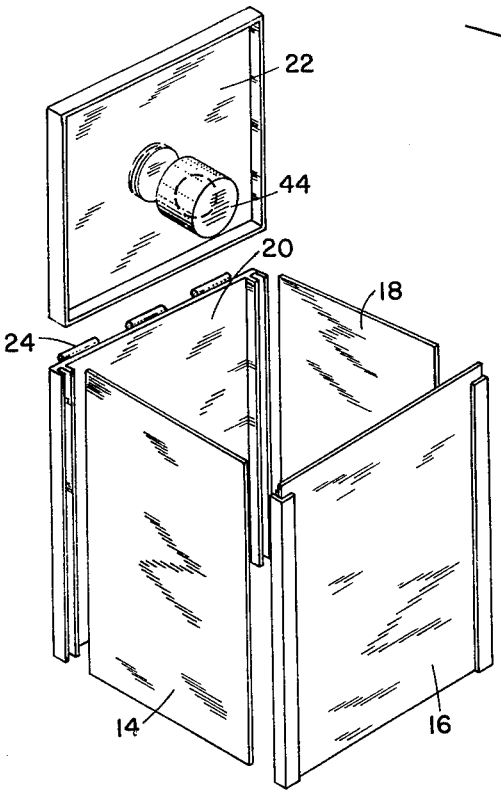
FIG. 3 is a perspective view pictorially illustrating a use of the device.
Figure 3:
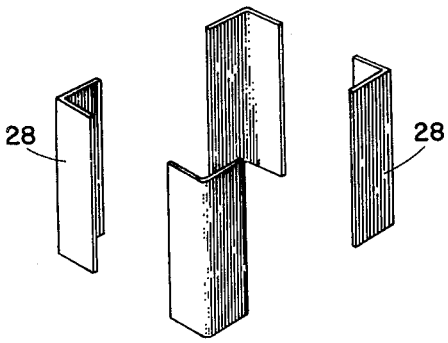
Figure 3:
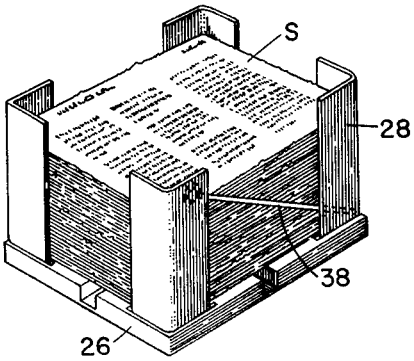

Referring for a moment to FIG. 2, it can be seen that the device 10 includes a base 26 of a substantially planar configuration having disposed at each of its opposite corners, vertical supports 28, FIG. 3, of right angular cross-sectional configurations. The supports 28 are so disposed as to engage vertical side surfaces of a stack, designated S, for supporting the stack in place on the upper surface of the base 26. Preferably, as illustrated in FIG. 2, the base 26 is provided with an angulated slot 30 at each of the corners of the base for receiving the lowermost ends of the vertical supports 28.

In practice, the slots 30 are of a right angular configuration and suitably dimensioned to receive the vertical supports 28 in a friction-fit engagement. Thus the vertical supports 28 are adapted to be removed for purposes of facilitating packaging and the like, prior to usage, and to be inserted into the slots 30, without the aid of tools or the like, in the assembly of the device.

As best shown in FIG. 2, the base includes an upwardly opening slot 32 including segments 34 and 36 which intersect to impart to the device a cruciform configuration. It is to be noted that the slot 32 is of a dimension such that passage therethrough of a needle 38 is readily accommodated.

The needle 38, as shown, includes a body 40 having located at one end thereof an eye 42. The length of the body 40 is such that it may be extended completely through either of the segments 34 or 36 of the slot 32, while the eye 42 is configured and adapted to receive an end portion of a length of binder twine, not shown, adapted to be drawn through the slot for purposes of passing binder twine beneath a stack of newspapers supported by the supports 28.

Preferably, a container 44 for a ball of binder twine is attached to the inner surface of the cover 22, whereby a ball of binder twine continuously is made available for use in binding a stack of collected newspapers into a bale. Additionally, the needle 38 is adapted to be stored in the device at any suitable location such as between adjacent vertical supports 28, FIG. 3.

OPERATION

It is believed that in view of the foregoing description, the operation of the device will readily be understood, however, it will be reviewed briefly at this point.

The device 10 is supplied to a potential user in kit form and thereafter assembled simply by inserting the vertical supports 28 into the slots 30 for forming a space between which is defined a receptacle for folded newspapers and the like. The housing 12 may or may not be supplied with the kit. However, in use the housing 12 preferably is positioned over the base 26 with the lid thereof being disposed in its closed configuration. When employed for storing the newspapers, the lid is simply lifted and the folded newspapers dropped downwardly into the device 10 to form a stack. Once the device 10 receives a substantial number of newspapers, sufficient to form a stack S, the housing 12 is removed from the stack and the needle 38 is extracted therefrom. A length of binder twine is then extracted from the container 44 and attached to the needle 38, at the eye 42. Subsequently, the needle is passed through each of the segments 34 and 36 of the cruciform slot 32 in order to position the twine in circumscribing relation with the stack. While the stack is supported by the vertical supports 28 compressive pressure is applied to the stack, at the upper surface thereof, for compressing the stack into a smaller bundle. The binder twine is then tightened and secured about the stack. Subsequently, the stack is lifted from between the supports 28 of the receptacle. Of course, should the stack become frictionally bounded within the receptacle, the vertical supports 28 are removed for thus facilitating release of the resulting bale of newspapers.

In view of the foregoing, it should readily be apparent that the device 10 comprises a practical solution to the problem of encouraging the storing and baling of newspapers for purposes of recycling.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A baling device in kit form for use in baling layered material such as folded newspaper and the like comprising:

A. a base having a planar surface for supporting thereon a stack of folded newspapers characterized by an upwardly opening slot of a cruciform configuration for accommodating passage of a length of binder twine beneath said stack in multiple directions;

B. means for laterally supporting said stack including at least four upright members each having at least one surface for engaging a vertical surface of the stack;

C. a cover telescopically receiving said upright members including at least four vertically oriented sides disposed in orthogonally related planes, means defining in said cover an opening having a vertically oriented axis, and a hinged lid for closing said opening; and D. a needle configured and dimensioned for use in drawing a length of binder twine through said slot.

2. The device of claim 1 wherein each of said upright members is characterized by a right angular cross-sectional configuration having a first planar surface adapted to engage a first side surface of the stack, and a second planar surface adapted to engage a second surface of the stack disposed in a second plane normally related to the plane of the first side surface, and said base includes at least four slots of right angular configurations for receiving said upright members in friction fit engagement.

3. The device of claim 2 wherein said base is of a substantially rectangular configuration and said slots are spaced inwardly from the corners of said base.

4. The device of claim 3 further comprising means mounted on said lid for accommodating storage of a ball of binder twine.

* * * * *